United States Patent [19]

Steiner

[11] 4,391,308

[45] Jul. 5, 1983

[54] SOAP DISPENSING SYSTEM

[75] Inventor: Robert L. Steiner, Chicago, Ill.

[73] Assignee: Steiner Corporation, Salt Lake City, Utah

[21] Appl. No.: 255,034

[22] Filed: Apr. 16, 1981

[51] Int. Cl.[3] ..... B65B 3/04

[52] U.S. Cl. ..... 141/18; 141/364; 222/207; 222/325; 215/311

[58] Field of Search ..... 141/1, 2, 18, 19, 114, 141/329, 330, 286, 346-366; 222/80, 81, 82, 88, 207, 325; 220/203, 266; 215/311

[56] References Cited

U.S. PATENT DOCUMENTS 4,149,573 4/1979 Cassia ..... 141/18

*Primary Examiner*—Houston S. Bell, Jr.

*Attorney, Agent, or Firm*—Emrich & Lee and Brown, Hill, Dithmar, Stotland, Stratman & Levy

[57] ABSTRACT

A system for dispensing liquid soap comprising a closed wall structure defining a container with a partition separating the container into a lower liquid soap reservoir and an upper refill compartment. Dispensing means is carried by the container for dispensing liquid soap from the reservoir. A refill well having a refill aperture therethrough provides communication between the reservoir and the refill compartment and is dimensioned to permit the free flow of liquid soap therethrough. A pusher member is disposed in the refill well and extends upwardly toward the upper refill compartment to contact a refill cartridge containing liquid soap which has an outwardly extending neck defining an outlet with a tubular drain adaptor in the refill cartridge in sealing relation with the neck providing communication between the inside and outside of the cartridge. The tubular drain adaptor has a drain opening therein extending above the juncture of the neck with the remainder of the cartridge to facilitate draining of soap therefrom, and a stopper in the tubular drain adaptor slidable between a sealed position thereof wherein liquid in the refill cartridge is sealed therein and an open position thereof wherein the stopper is positioned away from the drain opening to permit free flow of soap therefrom. Various embodiments of the pusher member and the stoppers are shown.

49 Claims, 16 Drawing Figures

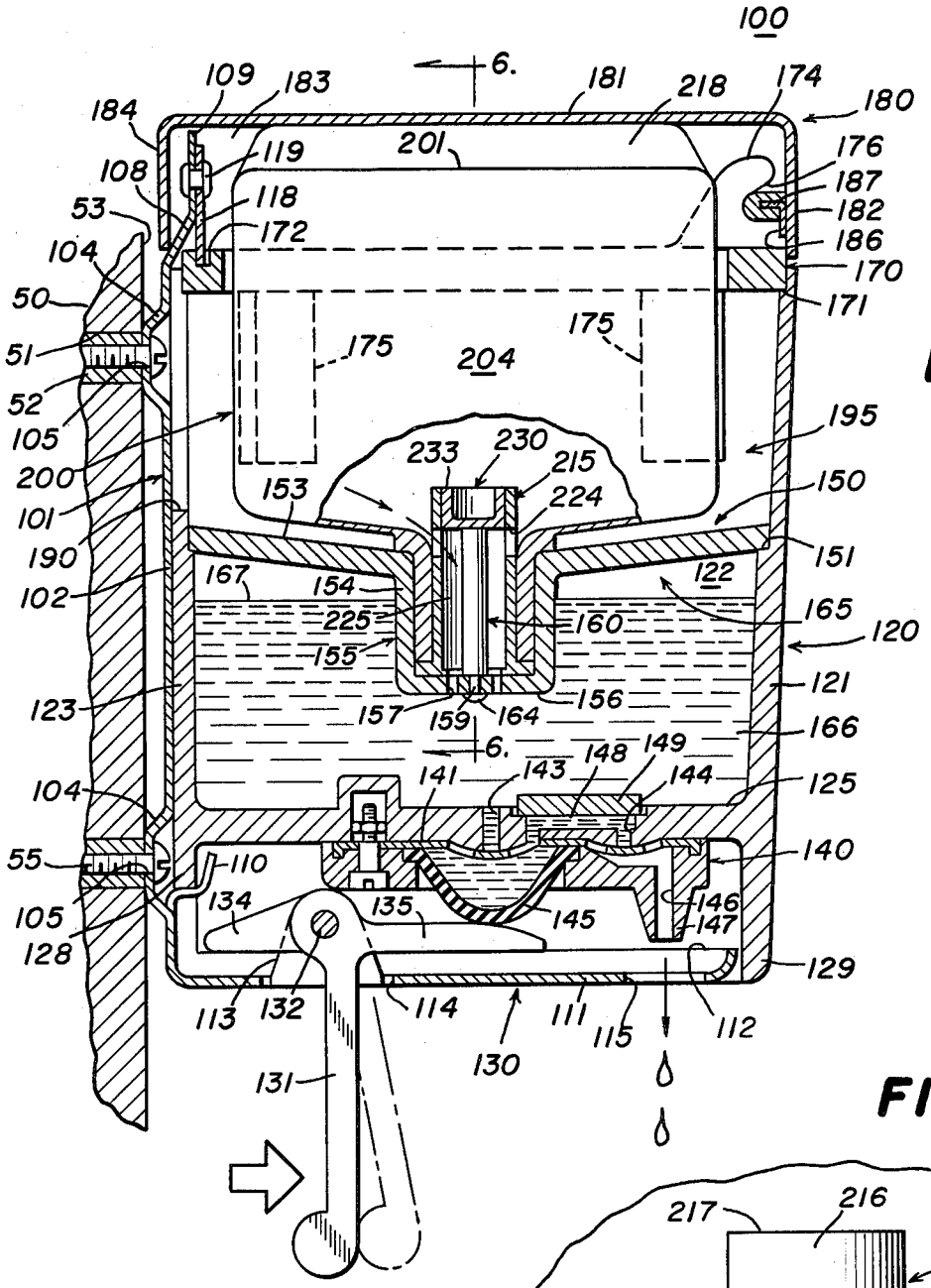
FIG. 3
FIG. 4
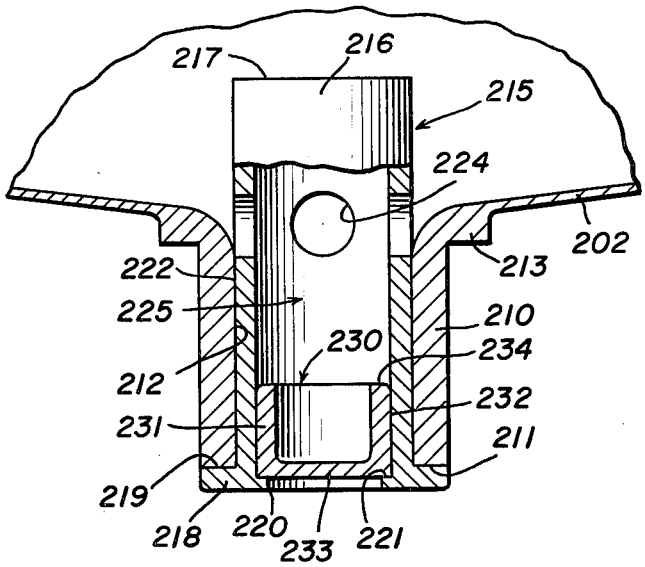
FIG. 5
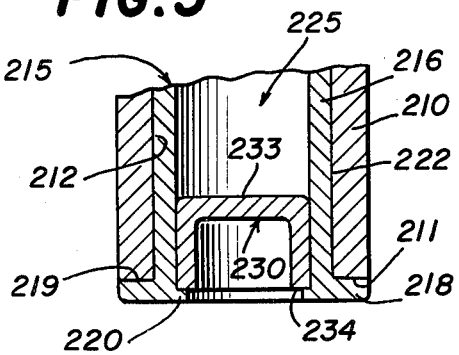

FIG. 8
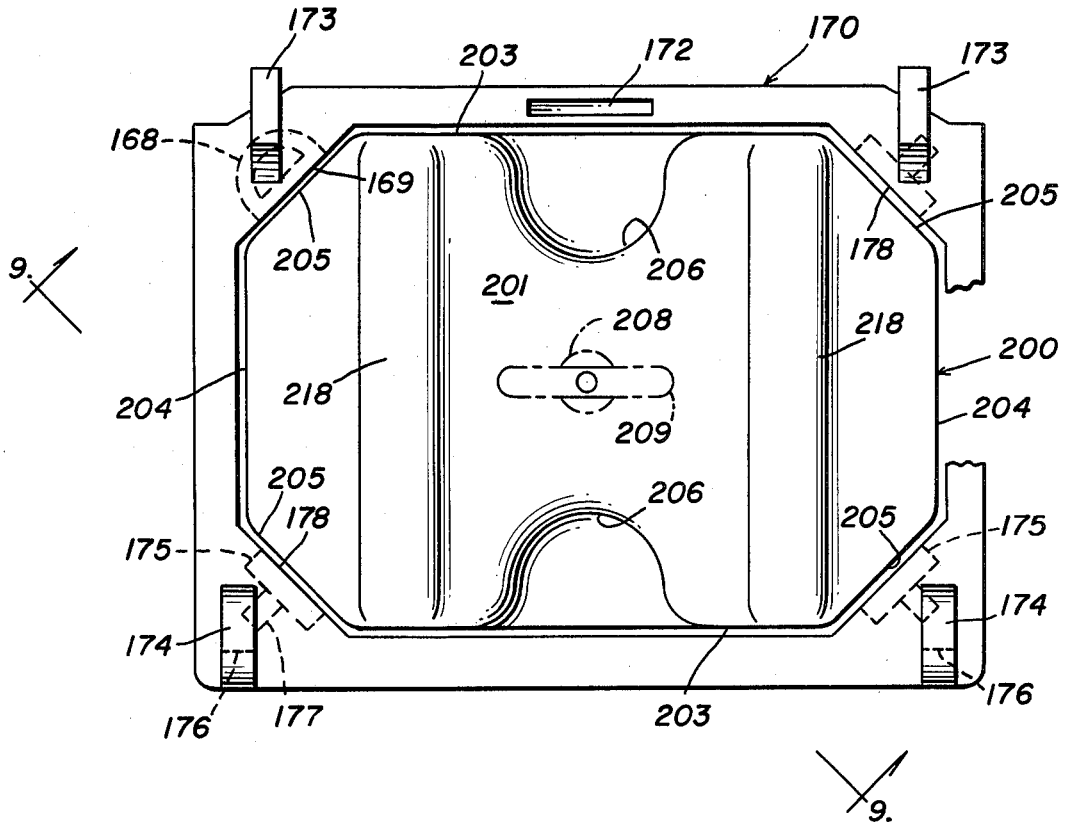
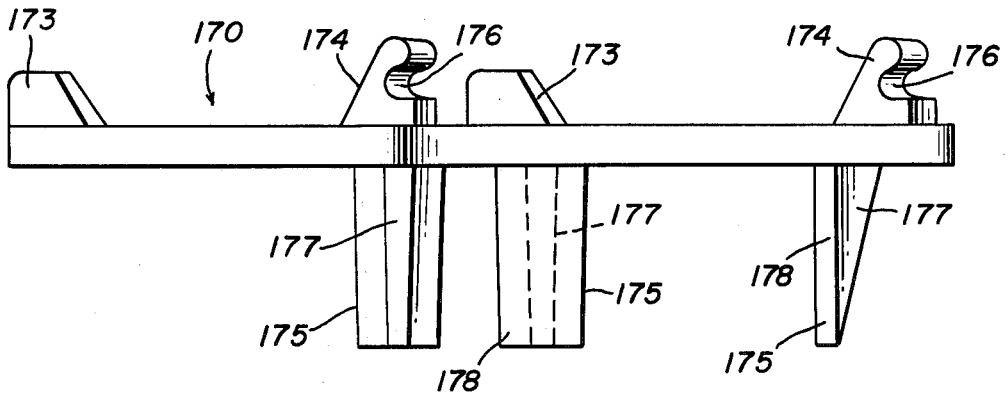
FIG. 9

SOAP DISPENSING SYSTEM

BACKGROUND OF THE INVENTION

The present invention relates to apparatus for dispensing liquid soap, normally in discrete small quantities or charges. Such dispensing apparatus is used, particularly for hygienic purposes, in public or institutional washrooms or the like or wherever there are a relatively large number of different users.

One such dispenser is disclosed in Cassia U.S. Pat. No. 4,149,573, assigned to the assignee of the present invention, and of which the present invention is an improvement. In the system of the '573 patent, a container is provided with a refill aperture which is dimensioned so that at equal pressure inside and outside said container liquid soap will flow therethrough only very slowly if at all. Thus, in refilling the container, a special squeeze-bottle type refill cartridge is used in order to force the soap through the refill aperture, the cartridge outlet being closed by a pierceable membrane which is ruptured by a piercing member adjacent to the refill aperture to permit the flow of liquid soap from the refill cartridge.

While this prior dispensing system works effectively, it has been found that an inconveniently long time is required for a serviceman to squeeze the contents of the refill cartridge into the reservoir of the dispenser. Generally quite a few squeezes of the refill cartridge are necessary in order completely to empty it, and if the serviceman does not completely empty the container, considerabe soap wastage results.

In order to alleviate these and other disadvantages, a system was devised by Cassia wherein a semi rigid refill container was positioned in the refill compartment of a soap container which also had a reservoir compartment. This system while advantageous in many aspects retains the disadvantage of having a foil or rupturable membrane on the refill container along with a cooperating piercing member in the soap dispenser. This permits inadvertent puncture of the foil membrane resulting in wasted product and undesirable clean up requirements.

SUMMARY OF THE INVENTION

Therefore, it is a general object of this invention to provide a liquid soap dispensing system, which includes a refillable dispenser, and which avoids the disadvantages of prior art dispensing systems while affording additional structural and operating advantages.

It is another object of this invention to provide a soap dispensing system of the type set forth which accommodates free flow of liquid soap from the refill cartridge through the refill aperture into the soap reservoir of the container.

Still another object of this invention is the provision of a liquid soap dispensing system of the type set forth, wherein the refill operation requires very little of a serviceman's time.

Another object of this invention is the provision of a liquid soap dispensing system which includes a refillable liquid soap container having a refill compartment therein in which a refill cartridge may be enclosed and left in place.

Yet another object of this invention is the provision of a liquid soap dispensing system of the type set forth which is adapted only for use with a specially designed refill cartridge.

In connection with the foregoing object, it is another object of this invention to provide a liquid soap dispensing system of the type set forth wherein the refill cartridge carries a stopper which is not liable to be punctured.

Yet another object of this invention is the provision of a refill cartridge uniquely designed for use with a system of the type set forth.

In connection with the foregoing object, it is another object of this invention to provide a refill cartridge which includes a tubular drain adaptor for cooperation with a pusher member in the soap dispenser.

In connection with the foregoing object, still another object of this invention is the provision of a refill cartridge having a removable cap which covers a vent aperture until after the cartridge is installed in a dispenser.

These and other objects of the present invention are achieved in a system for dispensing liquid soap comprising a closed wall structure defining a container, partition means separating the container into a lower liquid soap reservoir and an upper refill compartment, dispensing means carried by the container for dispensing liquid soap from the reservoir, a refill well having a refill aperture therethrough providing communication between the reservoir and the refill compartment and dimensioned to permit the free flow of liquid soap therethrough, a pusher member disposed in the refill well extending upwardly toward the upper refill compartment, a refill cartridge containing liquid soap and having an outlet, a tubular drain adaptor in the refill cartridge in sealing relation with the outlet providing communication through the tubular drain adaptor between the inside and outside of the cartridge, and a stopper in the tubular drain adaptor slidable between a sealed position thereof wherein liquid in the refill cartridge is sealed therein and an open position thereof wherein the stopper is positioned away from the outlet to permit free flow of soap therefrom, the refill cartridge being removably enclosed within the refill compartment in a refill configuration with the outlet disposed for cooperation with the refill well, the pusher member sliding the stopper within the tubular drain adaptor to the open position thereof when the refill cartridge is in the refill configuration thereof to permit the free flow of liquid soap from the refill cartridge to the reservoir thereby to refill same.

Another object of the present invention is to provide a system for dispensing liquid soap comprising a closed wall structure defining a container, partition means separating the container into a lower liquid soap reservoir and an upper refill compartment, dispensing means carried by the container for dispending liquid soap from the reservoir, a refill well having a refill aperture therethrough providing communication between the reservoir and the refill compartment and dimensioned to permit the free flow of liquid soap therethrough, a pusher member disposed in the refill well extending upwardly toward the upper refill compartment, a refill cartridge containing liquid soap and having an outwardly extending neck defining an outlet, a tubular drain adaptor in the refill cartridge in sealing relation with the neck providing communication through the tubular drain adaptor, between the inside and outside of the cartridge, the tubular drain adaptor having a drain opening therein extending above the juncture of the neck with the remainder of the cartridge to facilitate draining of soap therefrom, and a stopper in the tubular drain adaptor slidable between a sealed position thereof wherein liquid in the refill cartridge is sealed therein and an open position thereof wherein the stopper is positioned away from the drain opening to permit free flow of soap therefrom, the refill cartridge being removably enclosed within the refill compartment in a refill configuration with the outlet disposed for cooperation with the refill well, the pusher member sliding said stopper within the tubular drain adaptor to the open position thereof when the refill cartridge is in the refill configuration thereof to permit the free flow of liquid soap from the refill cartridge to the reservoir thereby to refill same.

Still another object of the present invention is to provide a refillable liquid soap dispenser comprising a closed wall structure defining a container, partition means dividing the interior of the container into a lower liquid soap reservoir and an upper refill compartment, dispensing means carried by the soap container for dispensing liquid soap from the container, a refill well having a refill aperture therethrough providing communication between the refill compartment and the reservoir and dimensioned to permit the free flow of liquid soap from the refill compartment to the reservoir, and a pusher member disposed in the refill well extending upwardly toward the upper refill compartment, the refill compartment being dimensioned to enclose a refill cartridge in a refill configuration disposed for cooperation with the refill well with the pusher member extending into the refill cartridge opening same to permit the free flow of liquid soap from the refill cartridge to the reservoir thereby to refill same.

A further object of the present invention is to provide a liquid soap refill cartridge comprising a vessel containing liquid soap and having an outlet, a tubular drain adaptor in the refill cartridge in sealing relation with the outlet providing communication through the tubular drain adaptor between the inside and outside of the cartridge, and a stopper in the tubular drain adaptor slidable between a sealed position thereof wherein liquid in the refill cartridge is sealed therein and an open position thereof wherein the stopper is positioned away from the outlet to permit free flow of soap therefrom.

Yet another object of the present invention is to provide a liquid soap refill cartridge comprising a vessel containing liquid soap and having an outwardly extending neck defining an outlet, a tubular drain adaptor in the refill cartridge in sealing relation with the neck providing communication through the tubular drain adaptor between the inside and outside of the cartridge, the tubular drain adaptor having a drain opening therein extending above the juncture of the neck with the remainder of the vessel to facilitate draining of soap therefrom, and a stopper in the tubular drain adaptor slidable between a sealed position thereof wherein liquid in the refill cartridge is sealed therein and an open position thereof wherein the stopper is positioned away from the drain opening to permit free flow of soap therefrom.

A still further object of the present invention is to provide a refill cartridge for a liquid soap dispenser comprising a vessel having an outlet, and a tubular drain adaptor in the vessel in sealing relation with the outlet providing communication through the tubular drain adaptor between the inside and outside of the cartridge.

A final object of the present invention is to provide a refill cartridge for a liquid soap dispenser comprising a vessel having an outwardly extending neck defining an outlet, and a tubular drain adaptor in the vessel in sealing relation with the neck providing communication through the tubular drain adaptor between the inside and outside of the cartridge, the tubular drain adaptor having a drain opening therein extending above the juncture of the neck with the remainder of the vessel to facilitate draining of soap therefrom.

Further features of the invention pertain to the particular arrangement of the parts of the liquid soap dispensing system whereby the above-outlined and additional operating features thereof are attained.

The invention, both as to its organization and method of operation, together with further objects and advantages thereof, will best be understood by reference to the following specification taken in connection with the accompanying drawings.

BRIEF DESCRIPTION OF THE DRAWINGS

FIG. 3 is a view in vertical section taken along the line 3—3 in FIG. 2, and illustrating the internal construction of the soap dispenser;

FIG. 4 is an enlarged fragmentary elevational view in partial vertical section of the outlet neck of the refill cartridge of the present invention illustrating the tubular drain adaptor and stopper therefor;

FIG. 5 is a view similar to FIG. 4 showing the stopper in reverse position;

FIG. 8 is a top plan view of the system as illustrated in FIG. 6;

FIG. 9 is an elevational view of the top plate of the dispenser, taken generally in the direction of the arrows 9—9 in FIG. 8;

DESCRIPTION OF THE PREFERRED EMBODIMENTS

Figure 1:
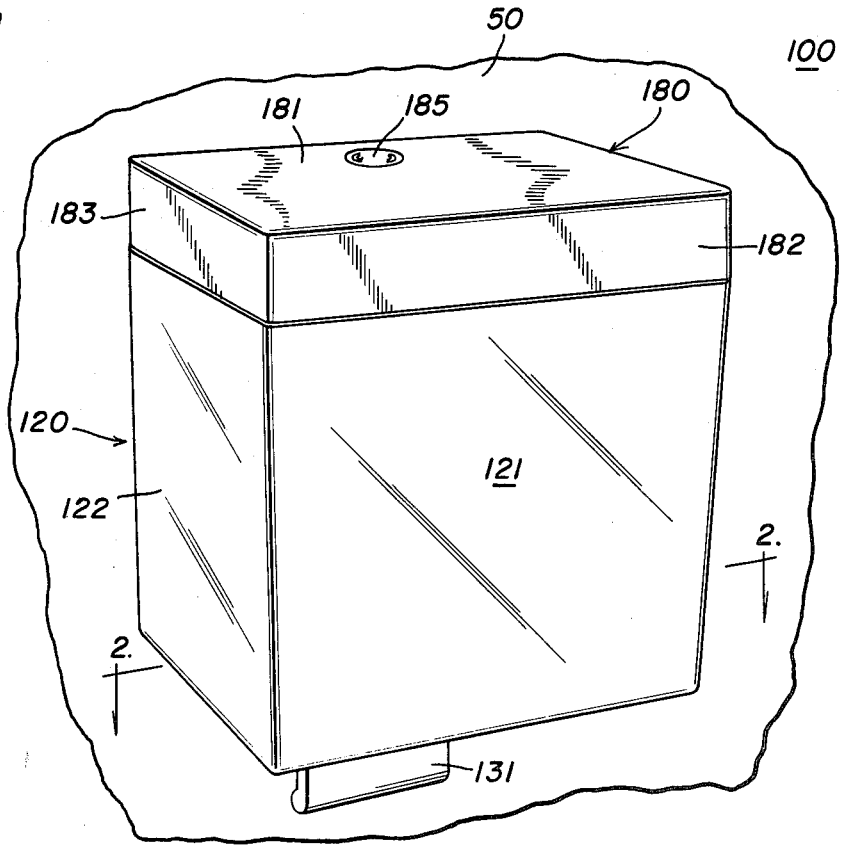
FIG. 1 is a front perspective view of a liquid soap dispenser constructed in accordance with and embodying the features of the present invention.
Figure 2:
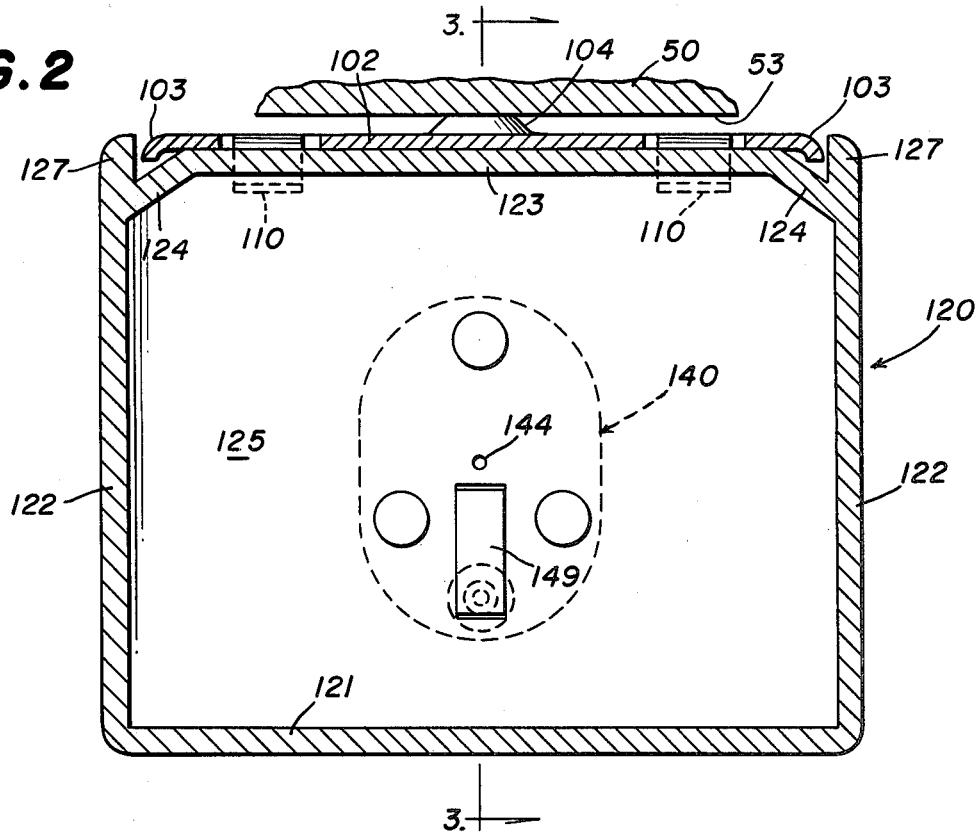
FIG. 2 is an enlarged view in horizontal section taken along the line 2—2 in FIG. 1.

Referring now to FIGS. 1 through 3 of the drawings, there is illustrated a soap dispenser 100, constructed in accordance with and embodying the features of the present invention. The soap dispenser 100 includes a mounting bracket 101, which includes a generally flat rectangular wall 102 disposed substantially vertically in use to provide a bearing surface, and having along each of the side edges thereof an integral curved side flange 103 which projects forwardly from the wall 102. Formed in the vertical wall 102 and projecting rearwardly therefrom in a direction away from the direction in which the side flanges 103 extend, are two substantially vertically aligned embossments 104, each having an opening 105 extending therethrough centrally thereof. Also formed in the wall 102 and projecting rearwardly therefrom are two embossments (not shown) which are disposed substantially in horizontal alignment with each other along a line disposed substantially midway between and being essentially the same dimensions as the embossments 104.

Integral with the wall 102 at the upper end thereof is an extension flange 108 which is inclined forwardly in the same general direction as the side flanges 103, and which is integral at the distal end thereof with an upwardly extending flange 109 which is substantially parallel to the wall 102. Punched from the wall 102 adjacent to the lower end thereof are two forwardly and upwardly extending support fingers 110.

Integral with the bottom end of the wall 102 and extending forwardly therefrom substantially normal thereto is a wall 111 which is disposed substantially horizontally in use and is provided around the periphery thereof with an integral upturned flange 112, which is in turn integral with the side flanges 103. Integral with the wall 111 and projecting upwardly therefrom substantially normal thereto are two parallel and laterally spaced-apart pivot brackets 113, a portion of the wall 111 between the pivot brackets 113 being cut out to define a generally rectangular opening 114. Formed in the wall 111 adjacent to the forward edge thereof and substantially midway between the side edges thereof is a circular soap discharge opening 115, the purpose of the openings 114 and 115 being described more fully below. A circular retaining plate 118 is pivotally secured to the inner surface of the upwardly extending flange 109 as by a rivet 119.

In use, the mounting bracket 101 is mounted on a wall 50, generally above and closely adjacent to a sink or washbasin or the like. Mounting openings or holes 51 are formed in the wall 50 and may have screw fastening inserts 52 set therein. The mounting bracket 101 is fixedly secured to the wall 50 by means of mounting screws 55 which are passed through the openings in the embossments 104 or similar embossments (not shown) and threadedly engaged in the inserts 52, the wall 102 being disposed substantially parallel to the surface 53 of the wall 50, and being in contact therewith only at the embossments 104, which serve to space the mounting bracket 101 a slight distance from the surface 53 of the wall 50.

The dispenser 100 also includes a soap container or housing 120, which is preferably formed of a translucent or transparent plastic, although it will be understood that any suitable material, either opaque or light-transmitting, could be used. The container 120 is generally box-like in configuration and includes a generally rectangular front wall 121, a pair of opposed side walls 122, a rear wall 124 and a rectangular bottom wall 125, the container 120 preferably being molded so that the walls 121, 122, 123 and 125 are all formed integrally with one another. The rear wall 123 is provided at the lateral side edges thereof with inturned forwardly inclined portions 124. The side walls 122 have rearwardly extending portions 127 which project rearwardly beyond the rear wall 123, whereby the rear wall 123 is recessed with respect to the side walls 122. In addition, the rear wall 123 extends downwardly below the bottom wall 125 to form a downwardly extending portion or mounting flange 128. Similarly, the front wall 121 and the side walls 122 all extend downwardly well below the bottom wall 125 and below the bottom edge of the mounting flange 128 to form a skirt 129.

Mounted below the bottom wall 125 of the container 120 is a pump assembly 130. The operation and construction of the pump assembly 130 is described in detail in U.S. Pat. No. 4,018,363 issued Apr. 19, 1977 to Cassia, and assigned to the assignee of the present invention, the disclosure of which patent is incorporated herein by reference. The pump assembly 130 includes an operating handle 131 provided with a pivot pin 132, the opposite ends of which are respectively mounted in the pivot brackets 113 on the mounting bracket wall 111 for pivotal movement of the operating handle 131 about the axis of the pivot pin 132, which extends substantially horizontally above the bracket wall 111 substantially parallel thereto and to the bracket wall 102. The handle 131 projects in use downwardly through the opening 114 in the bracket wall 111 and terminates at the lower end thereof in an enlarged gripping portion. The handle 131 also includes a stop member 134 which projects rearwardly from the pin 132 above the housing wall 111, and an actuating arm 135 which projects forwardly from the pin 132 above the bracket wall 111 and is substantially longer than the stop member 134.

The pump assembly 130 also includes a unitary pump housing 140, which is preferably of molded construction. The pump housing 140 is fixedly secured to the bottom wall 125 of the container 120 by suitable fasteners. Securely sandwiched between the pump housing 140 and the bottom wall 125 of the container 120 is a flexible diaphragm 141 having a plurality of suction apertures therethrough in surrounding relationship with a suction conduit or opening 143 in the bottom wall 135 of the container 120. The diaphragm 141 also has a plurality of discharge apertures therein disposed in surrounding relationship with a discharge conduit 144 in the bottom wall 125. A flexible resilient bowl 145 is disposed below the diaphragm 141 in the region of the suction conduit 143, the outer surface of the bowl 145 normally just touching the actuating arm 135 when the handle 131 is in its normal rest position illustrated in full line in FIG. 3. Disposed below the diaphragm 141 in the region of the discharge conduit 144 is a delivery conduit 146 in a spout 147 disposed immediately above and in alignment with the soap discharge opening 115 in the mounting bracket wall 111. A channel 148 normally enclosed by a removable insert 149 provides communication between the bowl 145 and the discharge conduit 144.

In operation, the soap container 120 is mounted on the mounting bracket 101 in a manner which is fully explained in the aforementioned U.S. Pat. No. 4,149,573, the disclosure of which is incorporated herein by reference. The operating handle 131 is pulled forwardly by a user in the direction of the arrow in FIG. 3 to the phantom line position thereby to compress the bowl 145 with the actuating arm 135 and expel a predetermined quantity of liquid soap from the delivery conduit 146, release of the operating handle 131 permitting reexpansion of the bowl 145 thereby to suck a fresh charge of liquid soap from the container 120 through the suction conduit 143 in preparation for the next dispensing operation, all as is more fully explained in the aforementioned Pat. Nos. 4,018,363 and 4,149,573.

The soap container 120 has a partition 150 which is disposed generally horizontally in use, and is substantially rectangular in shape with the peripheral edges thereof resting upon a ledge 151 formed in the inner surfaces of the soap container walls 121–123 and fixedly secured thereto as by ultrasonic welding. The partition 150 comprises four generally triangular sectors 152, the upper surfaces 153 of which slope gently downwardly toward the center of the partition 150 at which there is formed a well 155. The well 155 includes a cylindrical side wall 153 integral at the upper end thereof with the partition 150 and extending downwardly therebelow, the lower end thereof being terminated by a circular bottom wall 156. Formed in the bottom wall 156 adjacent to the outer edge thereof are four equiangularly spaped-apart drain holes 157 and a centrally located mounting aperture 159. Integral with the upper surface 153 of the partition 150 around the upper perimeter of the well 155 is an annular rim 158.

Mounted to the bottom wall 156 of the well 155 by means of a fastener 164 and extending upwardly therefrom axially therewith is a pusher member 160 in the form of a cylindrical rod 161 having a flat top surface 163, the bottom of the rod 161 having an internally threaded hole (not shown) to receive therein the fastener 164, thereby to mount the pusher member 160 inside the well 155. It is an important feature of the present invention that the top surface 163 of the pusher member 160 extends a predetermined distance upwardly above the annular rim 158 for a purpose to be explained.

It can be seen that the partition 150 cooperates with the bottom wall 125 and the walls 121–123 of the container 120 to define therebetween a liquid soap reservoir 165 adapted to be filled with a quantity of liquid soap 166 to a level 167, the position of the partition 150 in the soap container 120 being such that the reservoir 165 occupies slightly less than half the interior volume of the container 120. Fixedly secured to the partition 150 adjacent to one corner thereof and extending vertically upwardly therefrom and terminating adjacent to the upper end of the container 120 is a hollow vent tube 168, the lower end of which communicates with a vent opening **168*a* formed through the partition 150. The vent tube 168 is generally semicircular in transverse cross section and has a flat rectangular retaining surface 169 thereon facing inwardly toward the well 155 and disposed generally at a 45° angle to the rear wall 123 and the adjacent side wall 122**.

The container 120 is also provided with a top plate 170, see FIGS. 8 and 9, the outer perimeter of which conforms to the perimeter of the upper edge of the container 120 and is adapted to be seated on a ledge 171 formed in the inner surfaces of the container walls 121–123 and fixedly secured thereto as by ultrasonic welding. The top plate 170 has a large octagonal opening formed therein so that the top plate 170 essentially comprises a relatively narrow flange projecting horizontally inwardly from the walls of the container 120. Formed in the upper surface of the top plate 170 adjacent to the rear edge thereof is a shallow recess 172 adapted to receive therein the retaining plate 118 fixedly to hold the container 120 in place on the mounting bracket 101. Extending upwardly from the top plate 170 at the rear corners thereof are two rear abutments 173, while two forward abutments 174 respectively extend upwardly from the top plate 170 adjacent to the front corners thereof, the forward abutments 174 each having a notch 176 formed in the front surface thereof.

Four of the edges of the octagonal inner perimeter of the top plate 170 extend across the corners of the container 120 substantially at 45° angles to the adjacent walls thereof, one of these corner edges being substantially coplanar with the guide surface 169 of the vent tube 168. Integral with the top plate 170 respectively adjacent to the other three corner edges and extending downwardly therefrom are three positioning members 175, each having a stiffening rib 177 along the outer surface thereof, and each being provided with an inner flat rectangular guide surface 178. The guide surfaces 178 are all disposed substantially vertically and face inwardly toward the well 155, and are respectively substantially coplanar with the adjacent corner edges of the top plate 170.

The container 120 is also provided with a cover plate 180, see FIGS. 1 and 3, which includes a flat rectangular top wall 181, a front wall 182, a pair of opposed side walls 183 and a rear wall 184, all integrally connected in a unitary structure. Fixedly secured to the top wall 181 adjacent to the rear edge thereof is a key-operated latch mechanism 185. Fixedly secured to the inner surface of the front wall 182 is an elongated bearing plate 186 provided at the opposite ends thereof with rearwardly extending fingers 187, each preferably covered with a resilient cushioning material, the fingers 187 being respectively adapted to be received in the notches 176 in the forward abutments 174 of the top plate 170. The cover plate 180 is dimensioned so as completely to cover the top wall 170 of the container 120, with the walls 182–184 having a vertical extent sufficient to accommodate the inclined flange 108 and the upwardly extending flange 109 of the mounting bracket 101. In use, the fingers 187 are inserted into the notches 176 of the forward abutments 174, and the cover plate 180 is then pivoted down into position completely covering the top of the container 120, as illustrated in FIG. 3, a latch hook of the latch mechanism 185 engaging in a complementary keeper opening (not shown) in the upwardly extending flange 109 of the mounting bracket 101.

Formed in the rear wall 123 of the container 120 is a vertical slot 190 which extends from just above the partition 150 to the top wall 170, for a purpose to be explained more fully below. It can be seen that the cover plate 180 cooperates with the partition 150 and the walls 121–123 of the container 120 to define a closed refill compartment, generally designated by the numeral 195, communication between the refill compartment 195 and the liquid soap reservoir 165 being provided by the apertures 157 in the bottom wall 156 of the well 155, and by the hollow vent tube 168 and vent opening **168*a***.

Figure 6:
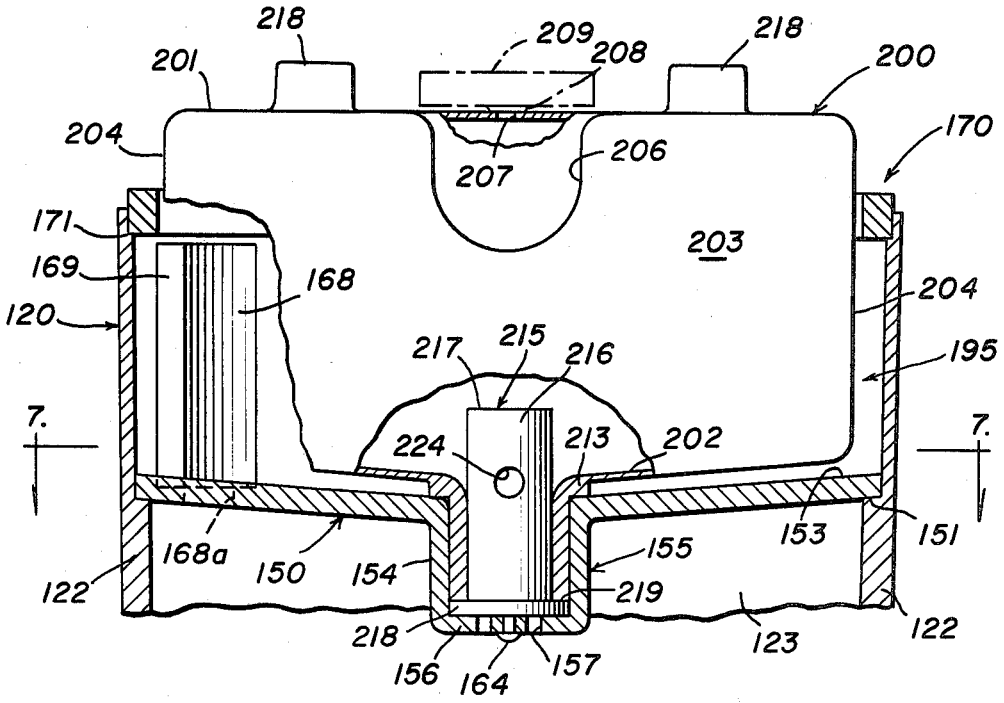
FIG. 6 is a fragmentary view in vertical section taken along the line 6—6 in FIG. 3, with the cover plate of the dispenser removed.
Figure 7:
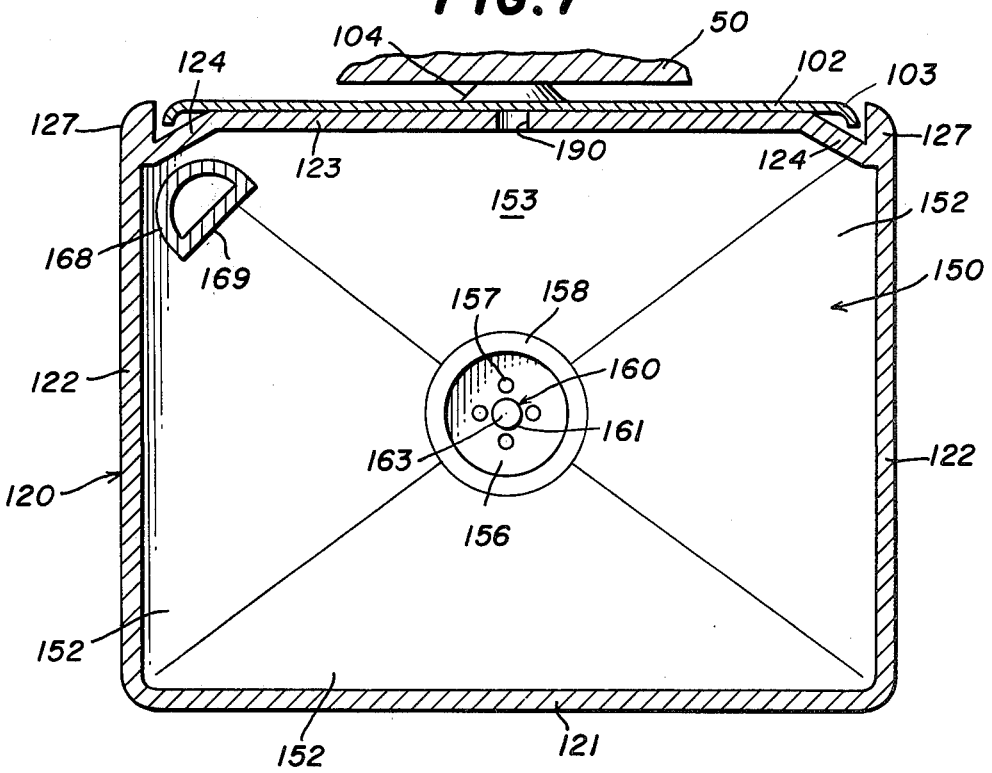
FIG. 7 is a view in horizontal section taken along the line 7—7 in FIG. 6.

The soap dispensing system of the present invention also includes a refill cartridge 200, FIGS. 3, 6 and 8, which is semirigid and preferably formed of a translucent soft plastic material, and is adapted to hold a supply of liquid soap for refilling the liquid soap reservoir 165 of the container 120. The refill cartridge 200 is generally in the shape of a polyhedron having top and bottom walls 201 and 202 interconnected by a pair of opposed side walls 203 and a pair of opposed end walls 204, the side walls 203 and the end walls 204 being generally perpendicular to each other and to the top and bottom walls 201 and 202. Connecting the side walls 203 to the end walls 204 and inclined substantially at 45° angles to each are four guide or corner walls 205, each of which is also perpendicular to the top and bottom walls 201 and 202. Formed at the junctions of the top wall 201 with the side walls 203 intermediate the ends thereof are two indentations or recesses 206 for receiving the fingers of a user. Formed in the top wall 201 centrally thereof is a vent aperture 207 surrounded by an upwardly extending septum or membrane 208, which is in turn connected to and closed by a cap 209 in the form of a knob or handle.

Integral with the bottom wall 202 and projecting outwardly therefrom centrally thereof is a cylindrical neck 210 having at the bottom end thereof an annular base rim 211 and at the top an annular collar forming a shoulder 213 by which it is coupled to the bottom wall 201, with the inner surface of the neck being designated 212.

An important feature of the present invention is a tubular drain adaptor 215 formed of a cylindrical body 216 having an upper end 217 and at the bottom thereof an annular flange 218 having an upper abutment surface 219 and an inwardly extending portion 220 forming a shoulder with an upper stop surface 221 thereon. The tubular drain adaptor 215 and more particularly the cylindrical body 216 thereof forms a central passageway 225 to provide communication between the inside of the refill cartridge 200 and the outside thereof, the tubular drain adaptor being provided with a plurality of drain holes 224 near the top edge 217 thereof.

The length of the tubular drain adaptor 215 is important as is the diameter thereof. Preferably, the tubular drain adaptor 215 is of sufficient length to extend well above the juncture of the neck 210 and the bottom wall 202 with the drain holes 224 or at least a portion thereof being positioned slightly above the collar or shoulder 213, for a purpose hereinafter described. Preferably, the outer diameter of the tubular drain adaptor 215 is just slightly smaller than the inner diameter of the neck 210 with the lateral extent of the flange 218 being coextensive with the outer periphery of the neck wall 210 thereby to provide a relative continuous and smooth outer surface for the neck 210 and the flange 218. The tubular drain adaptor 215 is inserted into the neck 210 after the refill cartridge 200 is blow molded, and if necessary the tubular adaptor is friction welded or ultrasonically welded to the neck 210 thereby to form essentially a one-piece construction.

The refill cartridge 200 is closed or sealed by means of the stopper 230, the stopper 230 being a cylindrical body 231 having an outer surface 232 and a cover plate 233, the upper annular rim being designated 234. Since the refill cartridge 200 is formed in two steps, that is, the container is preferably blow molded and thereafter the tubular drain adaptor 215 and stopper 230 are inserted thereinto, it can be seen that the stopper 230 is inserted into the tubular drain adaptor 215 prior to positioning the drain adaptor into the neck 210. In this way, the inwardly extending flange or shoulder 220 with the stop surfaces 221 thereon serves to retain the stopper 230 in the tubular drain adaptor 215 to prevent inadvertent removal of the stopper from the refill cartridge 200, thereby causing a loss of product and undesirable mess. Because the stopper 230 is not readily puncturable and is not readily removable by accident from the tubular drain adaptor 215 and more particularly from the refill cartridge 200, it is seen that the combination of the tubular drain adaptor and stopper is an improvement over prior art devices which are more likely to be accidentally punctured in storage and transit.

The stopper 230 is dimensioned such that the outer surface 232 thereof abuts the inner surface of the cylindrical body 216 and slidable therealong from a rest or sealed position illustrated in FIG. 4 wherein liquid soap in the refill cartridge 200 is sealed therein to the open or dispensing position illustrated in FIG. 3 wherein the refill cartridge 200 has been inserted into the well 155 and more particularly the pusher member 160 has caused the stopper 230 to move upwardly to the open position thereof wherein liquid soap in the refill cartridge 200 can flow through the drain holes 224 and the tubular drain adaptor 215 and thence downwardly through the bottom of the tubular drain adaptor, through the drain holes 157 in the bottom wall 156 of the well and into the reservoir 165. As may be seen, the placement of the drain holes 224 with respect to the juncture of the neck 210 and the bottom wall 202 facilitates complete drainage of soap from the cartridge 200.

Reference to FIG. 5 shows the same structure as in FIGS. 1–4, but with the exception that the stopper 230 is reversed in position such that the annular surface 234 contacts the stop surface 221 on the annular flange or shoulder 220. An advantage of the embodiment illustrated in FIG. 5 is that the stopper 230 and more particularly the cylindrical body 231 thereof serves to guide the pusher member 160 as the refill cartridge 200 is seated into the well 155.

When it is desired to refill the liquid soap reservoir 165 of the container 120, the cover plate 180 is unlocked and removed and a new refill cartridge 200 is inserted into the refill compartment 195. The refill cartridge 200 is shaped and dimensioned to just fit within the octagonal opening defined by the top plate 170, with the guide walls 205 of the refill cartridge 200 being respectively disposed for sliding engagement with the guide surfaces 178 of the positioning members 175 and the guide surface 169 of the vent tube 168, these guide surfaces cooperating accurately to guide the neck 210 of the refill cartridge 200 into the well 155. The neck 210 is dimensioned to fit within the well 155 with the annular shoulder 213 of the refill cartridge 200 seated on the annular rim 158 of the well 155. It is important that the drain holes 157 lie within the opening defined by the inwardly extending flange or shoulder 220 to ensure free drainage of liquid soap to the reservoir 165. The refill cartridge 200 is forced downwardly to a refill configuration wherein the bottom surface of the flange 218 bottoms on the bottom wall 156 of the well 155, thereby driving the pusher member 160 against the cover 233 to slide the stopper 230 from the sealed position thereof to the open position thereof to clear the drain holes 224 to permit free flow of liquid soap from the refill cartridge 200 through the passageway 225 and into the liquid soap reservoir 165. When the refill cartridge 200 has thus been inserted into its refill configuration in the refill compartment 195, the cap 209 is twisted off for breaking the membrane 208 and opening the vent aperture 207, thereby to equalize the pressure inside and outside said refill cartridge. The cover plate 180 is then locked back in place to close the refill compartment 195 and enclose the refill cartridge 200 therein. It will be appreciated that the entire cartridge replacement operation can be performed in a matter of seconds.

When the next service call is made, the serviceman can immediately tell from inspection of the translucent refill cartridge 200 whether or not it is empty. If it is empty, it is removed and discarded and a new refill cartridge 200 is inserted into its place in the manner described above. If the refill cartridge 200 is not empty, then the serviceman knows that the reservoir 165 is still substantially full and that no further refill is needed.

It will be appreciated that the dimensions of the tubular drain adaptor 215 as well as the drain holes 224 therein are such as readily to permit the free flow of liquid soap therethrough by gravity, without any necessity for squeezing the refill cartridge 200 or otherwise placing the contents thereof under greater than ambient pressure. Thus, the contents of the refill cartridge 200 will flow into the liquid soap reservoir 165 until the latter is substantially filled or until the cartridge 200 is empty. When the liquid soap reservoir 165 is filled, liquid soap will then gradually continue to flow thereinto from the cartridge 200 to replace liquid soap as it is dispensed from the reservoir 165.

Both the vent tube 168 and the vent opening **168*a* serve to equalize the pressure inside and outside the liquid soap reservoir 165 to facilitate the dispensing of soap therefrom. This separate venting of the reservoir 165 ensures operation of the system even in the event that the serviceman inserting the refill cartridge 200 forgets to remove the cap 209 and open the vent aperture 207. In that case, when the level of soap in the reservoir 165 falls below the bottom of the well 155, liquid soap will begin to flow through the passageway 225 by gravity and, at the same time, small quantities of air will pass upwardly through the passageway into the refill cartridge 200 to maintain the pressure therein. While the emptying of the refill cartridge 200 under this arrangement will be slower and less efficient than if the vent aperture 207 were open, it will be at a sufficient rate to replace the liquid soap in the reservoir 165** as it is dispensed therefrom.

The soap dispenser 100 is usable only with the refill cartridge 200 specifically designed therefor, so that the container 120 cannot be refilled with liquid soap from an unauthorized source. This purpose is furthered by the slot 190 in the rear wall 123 of the container 120. More particularly, it will be understood that by reason of the large dimensions of the well 155 and drain holes 157 therein which permit free flow of liquid soap therethrough by gravity under ambient pressure, there would be a temptation for unauthorized purveyors of liquid soap to simply pour free or bulk liquid soap into the refill compartment 195 and let it drain through the well 155. If this is attempted, however, the soap will immediately also flow out through the slot 190, running down the back of the container 100, onto the bracket wall 111 and along the outside of the pump assembly 130 creating a messy overflow and possibly fouling the dispensing mechanism. Thus, it will be appreciated that the slot 190 effectively prevents the accumulation of free liquid soap in the reservoir 165.

Another important feature of the present invention is that the length of the tubular adaptor member 215 and the placement of the drain holes 224 therein taken in conjunction with the length of the pusher member 160 so that the neck 210 of the refill cartridge 200 is in sealing position within the well 155 before the stopper 230 clears the drain apertures 224, thereby permitting liquid soap in the cartridge to drain into the well. This is an important feature which prevents soap from accumulating in the refill compartment 195 causing mess and additional clean-up time. As will be seen from a reference to FIG. 3 of the drawings, the top surface 163 of the pusher member 160 is at a level with or slightly above the uppermost portion of the drain holes 224 when the refill cartridge 200 is fully seated in the well 155, thereby fully opening the drain holes 224 for passage of liquid soap therethrough. It will be appreciated that if the embodiment illustrated in FIG. 5 is used then the pusher member 160 must be longer to accommodate the length of the cylindrical wall 231.

It will be noted that the finger recesses 206 in the refill cartridge 200 serve to facilitate handling thereof during insertion into and removal from the refill compartment 195. These recesses are particularly useful in removal of the spent refill cartridge 200 because of the very close fit between the walls of the cartridge 200 and the top plate 170 and because, when fully inserted into its refill configuration, the refill cartridge 200 only extends a slight distance above the top plate 170.

In storage of the refill cartridge 200 it is generally preferable to dispose the top wall 201 downward, since this affords a more stable base than does the neck 210. It will be appreciated that the ribs 218 provide bearing surfaces for supporting the refill cartridge 200 thereon during storage, these ribs 218 serving to pervent contact of the cap 209 with the underlying support surface or adjacent objects, thereby helping to prevent the cap 209 from accidentally being knocked off with resultant leakage of the liquid soap through the vent aperture 207. Similarly, it will be appreciated that the presence of the stopper 230 rather than a puncturable membrane in the neck 210 serves to minimize the chance of an accident during storage or handling.

Figure 10:
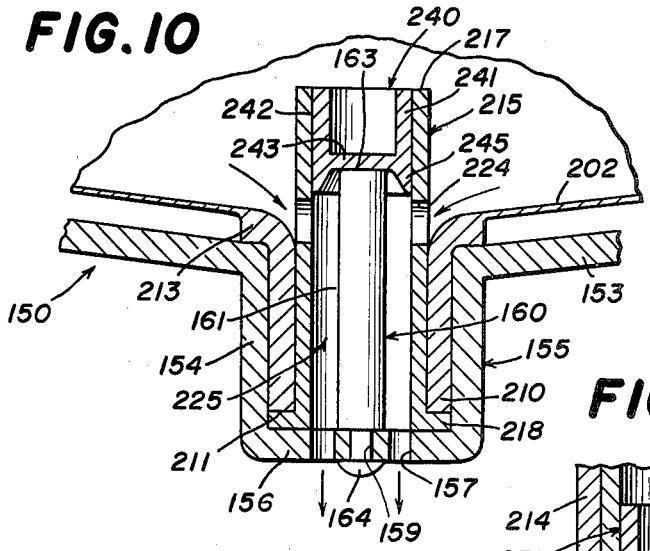
FIG. 10 is an enlarged fragmentary elevational view in partial vertical section of the outlet neck of the refill cartridge illustrating the tubular drain adaptor and another embodiment of the stopper therefor in the open position thereof.
Figure 11:
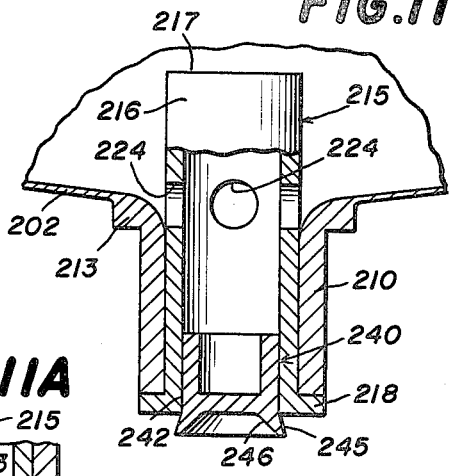
FIG. 11 is an enlarged fragmentary elevational view like FIG. 10 with the stopper thereof in the sealed position thereof.

Referring now to FIGS. 10 and 11 of the drawings, there is disclosed another stopper 240, the stopper 240 being of the same general shape and dimension as the stopper 230. The partition 150 is of the same design as previously described as is the well 155. The tubular drain adaptor 215 is also of the same general shape and design with the exception that the inwardly extending flange or shoulder 220 has been removed thereby to create a flush inner surface for the cylindrical body 216. The stopper 240 includes a generally cylindrical body 241 having an outer surface 242 and a horizontally extending cover 243. Downwardly depending from the cover 243 and integral with the remainder of the cylindrical body 241 is an outwardly extending skirt 245 of deformable material, the skirt 245 forming a frustoconical inner guide surface 246.

The stopper 240, as was the stopper 230, is slidable within the tubular drain adaptor 215 between a closed or sealed position illustrated in FIG. 11 and an open position illustrated in FIG. 10; in the open position the skirt 245 is positioned above the drain holes 224 in the tubular drain adaptor. In the closed position, the skirt 245 extends downwardly and outwardly beyond the flange 218 thereby serving to prevent inadvertent movement of the stopper 240 in the tubular drain adaptor 215 to the open position. In addition, the outward placement of the deformable skirt 245 may serve to create a more affirmative seal between the stopper 240 and the tubular drain adaptor 215, thereby to ensure that liquid soap inside the refill cartridge 200 does not leak.

Figure 11A:
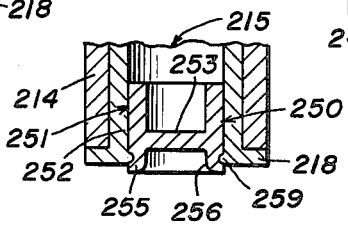
FIG. 11A is a fragmentary view in vertical section of the outlet neck of the refill cartridge illustrating another embodiment of the tubular drain adaptor and another embodiment of the stopper therefor.

Referring now to FIG. 11A, there is disclosed in another embodiment of the present invention in which a stopper 250 is comprised of a generally cylindrical body having an outer surface 252 in firm engagement with the inner surface of the associated tubular drain adaptor 215 and a horizontally positioned cover 253. The stopper 250 has a downwardly and outwardly extending skirt 255 having an inner surface 256 which is rounded and provides a guide surface for the associated pusher member 160. The drain adaptor 215 is provided with the usual flange 218 extending outwardly thereof to be coextensive with the neck 210, but in lieu of the inwardly extending shoulder 220, there is a bead 259 which serves to provide resistance for the stopper 250 such that the stopper 250 is not easily dislodged from the passageway 225 without affirmative action on the part of the user. For all the stoppers 230, 240 and 250 the cylindrical bodies thereof are shaped and dimensioned to fit snugly within the tubular drain adaptor 215, thereby to create an affirmative seal for the refill cartridge 200.

Figure 12:
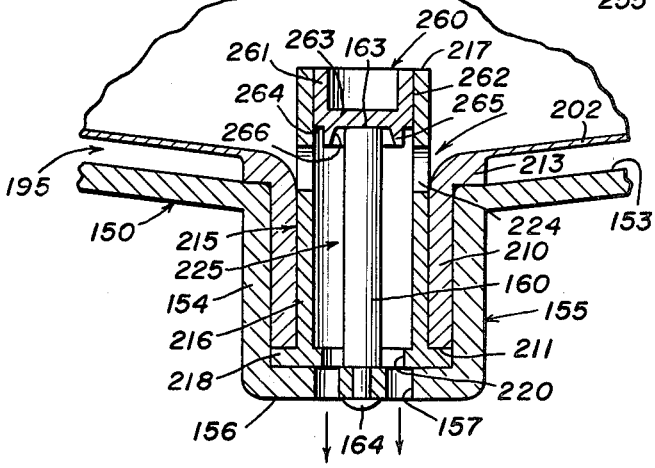
FIG. 12 is an enlarged fragmentary elevational view in partial vertical section of the outlet neck of the refill cartridge illustrating the tubular drain adaptor and another embodiment of the stopper therefor in the open position thereof.
Figure 13:
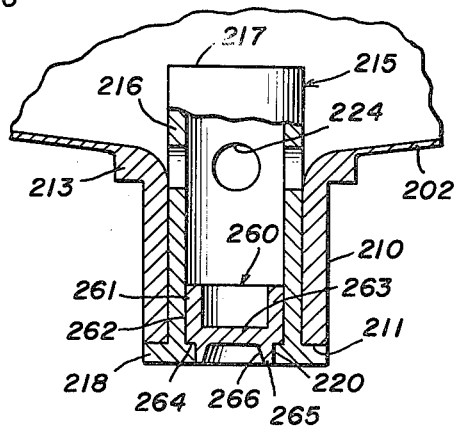
FIG. 13 is a view like FIG. 12 showing the stopper in the sealed position thereof.

Referring now to FIGS. 12 and 13 there is shown another embodiment of the present invention in which a stopper 260 is provided having a cylindrical body 261 with an outer sealing surface 262 adapted to be in sliding contact with the inner surface of the associated tubular drain adaptor 215. The stopper 260 has a horizontally disposed cover 263 and an annular shoulder 264 on the bottom thereof defined by a skirt 265 depending downwardly from the cover 263, the skirt forming a frustoconical guide surface 266 on the inside thereof. When the stopper 260 is used in association with the tubular guide member 215, as previously described, the annular shoulder 264 mates with and seats to the surface 221 of the annular shoulder or inwardly extending flange 220, thereby to provide a still more positive means for preventing inadvertent removal of the stopper 260 from the tubular drain adaptor 215. More specifically, the presence of the downwardly depending skirt 265 acts as a stiffener or strengthener for the stopper 260 further to prevent inadvertent removal of the stopper from the drain adaptor 215. The stopper 260 like the stopper 230 is slidable within the tubular drain adaptor 215 from a closed or sealed position illustrated in FIG. 13 to an open position illustrated in FIG. 12.

Figure 14:
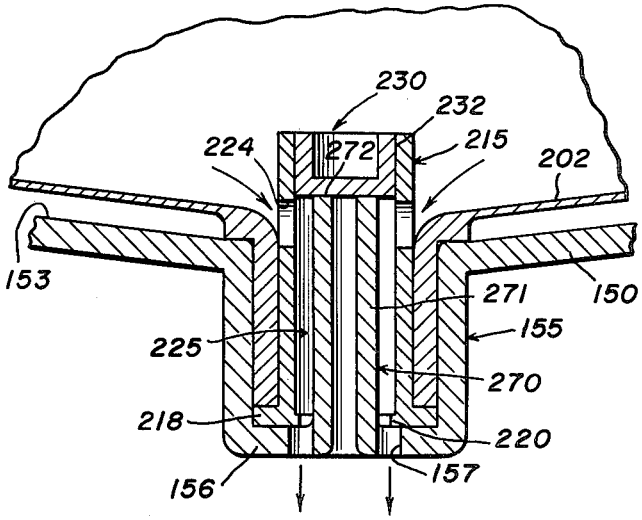
FIG. 14 is an enlarged fragmentary elevational view in partial vertical section of the outlet neck of the refill cartridge seated in the refill well of the soap container illustrating another embodiment of the pusher member.

Referring now to FIG. 14 there is disclosed an alternate embodiment for the pusher member 160 wherein a pusher member 270 is integrally formed with the well 155 and extends upwardly into the refill compartment 195, the pusher member 270 being comprised of a tubular member 271 having an annular top abutment surface 272 which contacts the bottom of the associated stopper 230. The pusher member preferably is integrally formed with the well 155 and extends upwardly thereof beyond the surface 153 of the partition 150, thereby to provide the required geometric relationship between the pusher 270, the tubular drain adaptor 215, the drain holes 224 therein and the stopper 230.

Figure 15:
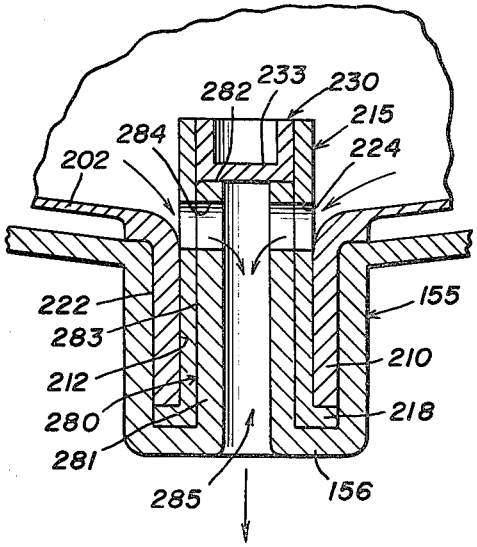
FIG. 15 is a view like FIG. 14 showing yet another embodiment of the pusher member.

Referring now to FIG. 15 there is illustrated yet another embodiment of the pusher member 160 wherein a pusher member 280 has a tubular member 281 preferably integral with the bottom wall 156 of the well 155, the tubular member having an annular top surface 282 which cooperates with the cover 233 of the associated stopper 230. The tubular member 281 has an outer surface 283 which is shaped to fit snugly within the tubular adaptor 215, and to be in sealed relationship therewith. The pusher member 280 and more particularly the tubular member 281 thereof has a plurality of drain holes 284 therein, which drain holes are in alignment with the drain holes 224 of the tubular drain adaptor 215 when the refill cartridge 200 is fully seated within the well 155 thereby to provide communication between the inside of the refill cartridge 200 and the reservoir 165 via a passageway 285 defined by the tubular pusher member 280. An advantage of the embodiment illustrated in FIG. 15 is that the drain openings from the refill compartment 195 to the reservoir 165 are larger, thereby facilitating more rapid draining of liquid soap from the refill cartridge 200 to the reservoir 165.

From the foregoing, it can be seen that there has been provided an improved soap dispensing system which includes a refillable liquid soap dispenser and a refill cartridge therefor wherein a stopper is used to close the refill cartridge rather than a rupturable membrane to reduce the likelihood of accidents.

There has also been provided an improved refill cartridge in which a stopper is utilized in lieu of a pierceable membrane and positive stops are provided to prevent inadvertent removal of the stopper.

While there has been described what at present is considered to be the preferred embodiments of the present invention, it will be understood that various modifications and alterations may be made therein without departing from the true scope of the present invention which is intended to be covered by the claims appended hereto.

What is claimed is:

1. A system for dispensing liquid soap comprising a closed wall structure defining a container, partition means separating said container into a lower liquid soap reservoir and an upper refill compartment, dispensing means carried by said container for dispensing liquid soap from said reservoir, a refill well having a refill aperture therethrough providing communication between said reservoir and said refill compartment and dimensioned to permit the free flow of liquid soap therethrough, a pusher member disposed in said refill well extending upwardly toward said upper refill compartment, a refill cartridge containing liquid soap and having an outlet, a tubular drain adaptor in said refill cartridge in sealing relation with said outlet providing communication through said tubular drain adaptor between the inside and outside of said cartridge, and a stopper in said tubular drain adaptor slidable between a sealed position thereof wherein liquid in said refill cartridge is sealed therein and an open position thereof wherein said stopper is positioned away from said outlet to permit free flow of soap therefrom, said refill cartridge being removably enclosed within said refill compartment in a refill configuration with said outlet disposed for cooperation with said refill well, said pusher member sliding said stopper within said tubular drain adaptor to the open position thereof when said refill cartridge is in the refill configuration thereof to permit the free flow of liquid soap from said refill cartridge to said reservoir thereby to refill same.

2. The system of claim 1, wherein said refill well is disposed substantially centrally of said partition means, said partition means having an upper surface sloping inwardly toward said refill well.

3. The system of claim 1, and further including a vent opening formed in said partition means for equalizing the pressure in said reservoir and said refill compartment, said cartridge being provided with vent means for venting same to said refill compartment.

4. The system of claim 1, wherein said tubular drain adaptor is a hollow right circular cylinder.

5. The system of claim 1, wherein said tubular drain adaptor has an annular flange at one end thereof sealed to said outlet, said annular flange having an outer dimension slightly smaller than the inner dimension of said well to sealingly fit therewithin.

6. The system of claim 1, wherein said tubular drain adaptor is sealed at one end thereof to said outlet, said one end of said tubular drain adaptor having an inwardly extending annular flange forming a shoulder to prevent said stopper from being inadvertently removed from said tubular drain adaptor.

7. The system of claim 1, wherein said pusher member is a solid rod extending upwardly into said refill compartment.

8. The system of claim 1, wherein said pusher member is tubular having the free end thereof extending beyond said refill well into said refill compartment.

9. The system of claim 8, wherein said hollow pusher member is integrally formed with said well, said refill aperture being the passageway formed by said hollow pusher member.

10. The system of claim 1, wherein said stopper has a downwardly extending skirt on the bottom thereof, said skirt being of deformable material such that when said stopper is in the sealed position thereof said skirt extends downwardly and outwardly beyond the end of said tubular drain adaptor and when said stopper is sliding between the sealed position thereof to the open position thereof said deformable skirt deforms inwardly such that the outer diameter thereof is substantially the same as the inner diameter of said tubular drain adaptor.

11. The system of claim 1, wherein said stopper has a downwardly extending skirt portion of deformable material and said tubular drain adaptor has an inwardly extending bead at the end thereof, said bead and said deformable skirt cooperating to retain said stopper in said tubular drain adaptor and to prevent inadvertent dislodgement thereof.

12. The system of claim 1, wherein said stopper has a downwardly extending skirt portion of deformable material extending from the bottom of said stopper inwardly of the periphery thereof to form an annular shoulder between said skirt and the stopper periphery on the stopper bottom, said tubular adaptor having an inwardly extending annular shoulder on the bottom thereof for cooperation with the annular shoulder on said stopper to prevent inadvertent dislodgement thereof.

13. A system for dispensing liquid soap comprising a closed wall structure defining a container, partition means separating said container into a lower liquid soap reservoir and an upper refill compartment, dispensing means carried by said container for dispensing liquid soap from said reservoir, a refill well having a refill aperture therethrough providing communication between said reservoir and said refill compartment and dimensioned to permit the free flow of liquid soap therethrough, a pusher member disposed in said refill well extending upwardly toward said upper refill compartment, a refill cartridge containing liquid soap and having an outwardly extending neck defining an outlet, a tubular drain adaptor in said refill cartridge in sealing relation with said neck providing communication through said tubular drain adaptor between the inside and outside of said cartridge, said tubular drain adaptor having a drain opening therein extending above the juncture of said neck with the remainder of said cartridge to facilitate draining of soap therefrom, and a stopper in said tubular drain adaptor slidable between a sealed position thereof wherein liquid in said refill cartridge is sealed therein and an open position thereof wherein said stopper is positioned away from said drain opening to permit free flow of soap therefrom, said refill cartridge being removably enclosed within said refill compartment in a refill configuration with said outlet disposed for cooperation with said refill well, said pusher member sliding said stopper within said tubular drain adaptor to the open position thereof when said refill cartridge is in the refill configuration thereof to permit the free flow of liquid soap from said refill cartridge to said reservoir thereby to refill same.

14. The system of claim 13, wherein said tubular drain is sealed at one end thereof to said neck, said one end of said tubular drain adaptor having an inwardly extending annular flange forming a shoulder for preventing said stopper from being inadvertently removed from said tubular drain adaptor.

15. The system of claim 13, wherein said pusher member extends vertically through said tubular drain adaptor to a position not lower than the tops of said drain holes in said adaptor.

16. The system of claim 13, wherein said pusher member is tubular having a drain opening therein which when said stopper is in the open position thereof said drain opening in said tubular drain adaptor is in alignment with the drain opening in said pusher member, thereby to permit liquid soap in said refill container to flow through the aligned openings into said reservoir.

17. The system of claim 16, wherein each of said tubular drain adaptor and said pusher member has an even number of drain openings therein.

18. A refillable liquid soap dispenser comprising a closed wall structure defining a container, partition means dividing the interior of said container into a lower liquid soap reservoir and an upper refill compartment, dispensing means carried by said soap container for dispensing liquid soap from said container, a refill well having a refill aperture therethrough providing communication between said refill compartment and said reservoir and dimensioned to permit the free flow of liquid soap from said refill compartment to said reservoir, and a pusher member disposed in said refill well extending upwardly toward said upper refill compartment, said refill compartment being dimensioned disposed for cooperation with said refill well with said pusher member extending into the refill cartridge opening same to permit the free flow of liquid soap from the refill cartridge to said reservoir thereby to refill same.

19. The refillable liquid soap dispenser of claim 18, wherein said pusher member is a rod.

20. The refillable liquid soap dispenser of claim 18, wherein said pusher member is tubular.

21. The refillable liquid soap dispenser of claim 18, wherein said pusher member is tubular and is disposed with a drain opening near the upper end thereof.

22. The refillable liquid soap dispenser of claim 21, wherein said pusher member has an even number of drain openings therein.

23. A liquid soap refill cartridge comprising a vessel containing liquid soap and having an outlet, a tubular drain adaptor in said refill cartridge in sealing relation with said outlet providing communication through said tubular drain adaptor between the inside and outside of said cartridge, and a stopper in said tubular drain adaptor slidable between a sealed position thereof wherein liquid in said refill cartridge is sealed therein and an open position thereof wherein said stopper is positioned away from said outlet to permit free flow of soap therefrom.

24. The liquid soap refill cartridge of claim 23, wherein said vessel has a vent aperture therein opposite said outlet for equalizing the pressure inside and outside said vessel thereby to facilitate the flow of liquid soap therefrom through said tubular drain adaptor, and cap means removably attached to said vessel and normally closing said vent aperture to prevent accidental escape of liquid soap through said vent aperture during storage or handling of said vessel.

25. The liquid soap refill cartridge of claim 23, wherein said tubular drain adaptor has a drain opening near the end thereof away from said outlet.

26. The liquid soap refill cartridge of claim 25, wherein said tubular adaptor has an even number of drain openings therein.

27. The liquid soap refill cartridge of claim 23, wherein said vessel is a semirigid synthetic organic resin.

28. The system of claim 23, wherein said stopper has a downwardly extending skirt on the bottom end thereof, said skirt being of deformable material such that when said stopper is in the sealed position thereof said skirt extends downwardly and outwardly beyond the end of said tubular drain adaptor and when said stopper is sliding between the sealed position thereof to the open position thereof said deformable skirt deforms inwardly such that the outer diameter thereof is substantially the same as the inner diameter of said tubular drain adaptor.

29. The system of claim 23, wherein said stopper has a downwardly extending skirt portion of deformable material and said tubular drain adaptor has an inwardly extending bead at the end thereof away from said refill compartment, said bead and said deformable skirt cooperating to retain said stopper in said tubular drain adaptor and to prevent inadvertent dislodgement thereof.

30. The system of claim 23, wherein said tubular drain adaptor is sealed at one end thereof to said outlet, said one end of said tubular drain adaptor having an inwardly extending annular flange forming a shoulder for preventing said stopper from being inadvertently removed from said tubular drain adaptor.

31. A liquid soap refill cartridge comprising a vessel containing liquid soap and having an outwardly extending neck defining an outlet, a tubular drain adaptor in said refill cartridge in sealing relation with said neck providing communication through said tubular drain adaptor between the inside and outside of said cartridge, said tubular drain adaptor having a drain opening therein extending above the juncture of said neck with the remainder of said vessel to facilitate draining of soap therefrom, and a stopper in said tubular drain adaptor slidable between a sealed position thereof wherein liquid in said refill cartridge is sealed therein and open position thereof wherein said stopper is positioned away from said drain opening to permit free flow of soap therefrom.

32. The liquid soap refill cartridge of claim 31, wherein said vessel has a vent aperture therein opposite said outlet for equalizing the pressure inside and outside said vessel thereby to facilitate the flow of liquid soap therefrom through said tubular drain adaptor, and cap means removably attached to said vessel and normally closing said vent aperture to prevent accidental escape of liquid soap through said vent aperture during storage of said vessel.

33. The cartridge of claim 32, and further comprising bearing structure extending from said vessel in the same direction and for at least the same distance as said cap means for supporting said vessel during storage without interference with said cap means.

34. The cartridge of claim 33, wherein said bearing structure comprises two elongated ribs respectively disposed on opposite sides of said cap means and spaced a predetermined distance therefrom.

35. The cartridge of claim 31, wherein said vessel includes recessed portions adapted to receive the fingers of a user to facilitate handling of said cartridge during movement thereof to and from said refill configuration.

36. A refill cartridge for a liquid soap dispenser comprising a vessel having an outlet, and a tubular drain adaptor in said vessel in sealing relation with said outlet providing communication through said tubular drain adaptor between the inside and outside of said cartridge.

37. The refill cartridge of claim 36, and further comprising a stopper for insertion into said tubular drain adaptor and slidable therealong between a sealed position thereof wherein liquid soap in said refill cartridge is sealed therein and an open position thereof wherein said stopper is positioned away from said outlet to permit free flow of liquid soap therefrom.

38. The liquid soap refill cartridge of claim 36, wherein said vessel has a vent aperture therein opposite said outlet for equalizing the pressure inside and outside said vessel thereby to facilitate the flow of liquid soap therefrom through said tubular drain adaptor, and cap means removably attached to said vessel and normally closing said vent aperture to prevent accidental escape of liquid soap through said vent aperture during storage or handling of said vessel.

39. The refill cartridge of claim 36, wherein said vessel has a top wall and a bottom wall interconnected by side walls, said side walls being arranged in an octagonal configuration.

40. The cartridge of claim 38, and further comprising bearing structure extending from said vessel in the same direction and for at least the same distance as said cap means for supporting said vessel during storage without interference with said cap means.

41. The cartridge of claim 40, wherein said bearing structure comprises two elongated ribs respectively disposed on opposite sides of said cap means and spaced a predetermined distance therefrom.

42. The cartridge of claim 36, wherein said vessel includes recessed portions adapted to receive the fingers of a user to facilitate handling of said cartridge during movement thereof to and from said refill configuration.

43. A refill cartridge for a liquid soap dispenser comprising a vessel having an outwardly extending neck defining an outlet, and a tubular drain adaptor in said vessel in sealing relation with said neck providing communication through said tubular drain adaptor between the inside and outside of said cartridge, said tubular drain adaptor having a drain opening therein extending above the juncture of said neck with the remainder of said vessel to facilitate draining of soap therefom.

44. The refill cartridge of claim 43, and further comprising a stopper for insertion into said tubular drain adaptor and slidable therealong between a sealed position thereof wherein liquid soap in said refill cartridge is sealed therein and an open position thereof wherein said stopper is positioned away from said drain opening to permit free flow of liquid soap therefrom.

45. The liquid soap refill cartridge of claim 43, wherein said vessel has a vent aperture therein opposite said outlet for equalizing the pressure inside and outside said vessel thereby to facilitate the flow of liquid soap therefrom through said tubular drain adaptor, and cap means removably attached to said vessel and normally closing said vent aperture to prevent accidental escape of liquid soap through said vent aperture during storage or handling of said vessel.

46. The cartridge of claim 45, and further comprising bearing structure extending from said vessel in the same direction and for at least the same distance as said cap means for supporting said vessel during storage without interference with said cap means.

47. The cartridge of claim 46, wherein said bearing structure comprises two elongated ribs respectively disposed on opposite sides of said cap means and spaced a predetermined distance therefrom.

48. The cartridge of claim 43, wherein said vessel includes recessed portions adapted to receive the fingers of a user to facilitate handling of said cartridge during movement thereof to and from said refill configuration.

49. The refill cartridge of claim 43, wherein said vessel has a bottom wall and a top wall interconnected by side walls, said side walls being arranged in an octagonal configuration.

* * * * *

UNITED STATES PATENT AND TRADEMARK OFFICE

CERTIFICATE OF CORRECTION

PATENT NO. : 4,391,308

DATED : July 5, 1983

INVENTOR(S) : Robert L. Steiner

It is certified that error appears in the above-identified patent and that said Letters Patent are hereby corrected as shown below:

Column 2, line 53, "dispending" should be --dispensing--.

Column 16, line 51, after "dimensioned" insert --to enclose a refill cartridge in a refill configuration--.

Signed and Sealed this

*Twentieth* Day of *September 1983*

[SEAL]

*Attest:*

GERALD J. MOSSINGHOFF

*Attesting Officer*

*Commissioner of Patents and Trademarks*